US006197155B1

(12) United States Patent
Wurster et al.

(10) Patent No.: US 6,197,155 B1
(45) Date of Patent: Mar. 6, 2001

(54) COATED WEB PRINTING PAPER WITH COLD-SET SUITABILITY

(75) Inventors: Hartmut Wurster, Friedberg; Hans-Peter Hofmann, Dachau, both of (DE)

(73) Assignee: Haindl Papier GmbH, Augsburg (DE)

( * ) Notice: Subject to any disclaimer, the term of this patent is extended or adjusted under 35 U.S.C. 154(b) by 0 days.

(21) Appl. No.: 09/169,010

(22) Filed: Oct. 9, 1998

(30) Foreign Application Priority Data

Oct. 11, 1997 (DE) ..... 197 45 082

(51) Int. Cl.[7] ..... D21H 27/00; D21H 17/04; D21H 17/28; D21H 17/68

(52) U.S. Cl. ..... 162/135; 162/158; 162/181.1; 162/181.8; 162/175; 162/173; 428/340; 428/341

(58) Field of Search ..... 162/135, 158, 162/181.1, 181.2, 181.4, 181.8, 175, 173; 427/391, 361; 428/331, 537.5, 688, 446, 330, 340, 341, 328; 106/465, 416, 20 R, 468, 464, 463, 486, 474

(56) References Cited

U.S. PATENT DOCUMENTS

| | | | | |
|---|---|---|---|---|
| 4,820,554 | * | 4/1989 | Jones et al. | 427/391 |
| 4,826,536 | * | 5/1989 | Raythatha et al. | 106/465 |
| 4,854,971 | * | 8/1989 | Gane et al. | 106/286.5 |
| 4,943,349 | * | 7/1990 | Gomez | 162/158 |
| 5,120,365 | * | 6/1992 | Kogler | 106/415 |
| 5,423,911 | * | 6/1995 | Coutelle et al. | 106/416 |
| 5,882,396 | * | 3/1999 | Hiorns | 106/464 |

FOREIGN PATENT DOCUMENTS

| | | |
|---|---|---|
| 4400609 | 7/1995 | (DE) . |
| 0 377 983 | 7/1990 | (EP) . |
| 0 777 014 | 6/1997 | (EP) . |
| 0 785 307 A2 | 7/1997 | (EP) . |

* cited by examiner

*Primary Examiner*—Peter Chin
*Assistant Examiner*—Jose'A. Fortuna
(74) *Attorney, Agent, or Firm*—Smith Gambrell & Russell, LLP

(57) ABSTRACT

A lightweight, coated web printing paper is described for suitability in the cold-set printing process, which has specific values for water penetration and ink absorption and has gloss values in the 40–50% range for a smoothness in the range of 500 sec. Bekk.

20 Claims, No Drawings

COATED WEB PRINTING PAPER WITH COLD-SET SUITABILITY

The invention relates to a coated web printing paper suitable for printing with cold-set offset printing ink.

Such a paper is already known from EP-A 0 785 307. As regards the need for enhanced cold-set paper qualities and the related problems, the introductory statements in this older document are referred to.

The web printing paper described in EP-A 0 785 307 is a so-called mat quality. It is explained in detail in this older document that to achieve the pressability and printability of a coated web printing paper in the cold-set offset process, special demands must be made on the paper regarding its wetting/water penetration behavior and its ink absorption speed. These are properties which at times are in turn considerably disadvantaged by a glazing on smoothnesses of 1,000 to 1,600 sec. Bekk, as is necessary for producing typical smooth papers. For this reason, it was first managed to provide a coated mat quality for the cold-set process.

Now that a high degree of advertizing effectiveness is to be achieved via newspaper supplements, only glossy paper can be considered for certain advertizing orders. In the absence of cold-set-suitable glossy LWC papers, these brochures are still printed via the conventional heat-set process as before. To enable the cold-set printer to take on such printing orders as well, the main point was to develop a glossy paper quality that closes this quality gap and can be pressed and printed without problems via the printing machine configurations that are typical in the newspaper printing domain (eight-tower and satellite printing machines). After such a quality has established itself in the domain of mass-produced printing paper, economic aspects are also to be taken into consideration.

The invention is therefore based on the technical problem of providing a coated web printing paper for the cold-set process that has sufficient gloss for more demanding printing products, in particular advertizing supplements and the like, and can be manufactured economically.

This technical problem is solved by the features of patent claim 1.

The mat paper quality described in EP-A-0 785 307 for the cold-set process is first of all characterized by its water absorbency, measured on the wetting angle of contact of a water drop or by determining the penetration behavior. A further important property of the paper, which may be dependent on the printing machine to a certain extent, however, is the ink absorption behavior of the paper. It was already indicated in EP-A-0 785 307, namely on page 12, lines 19–23, that the two aforementioned properties reciprocally determine each other to a certain extent, in such a way that a paper is also suitable for printing in the cold-set process if the values for the water absorption capacity and the ink absorption range in their opposite limit ranges, in such a way that in this case a certain compensation of the properties seems to take place. The reasons for this are not yet known.

It has also been shown that a glossy printing paper with cold-set suitability cannot be obtained by glazing to a high smoothness value as is otherwise typical for LWC papers.

Not only the combination of the two aforementioned properties, which appear essential for suitability in the cold-set process, is affected by this. In addition, the paper's pick-resistance generally required for the offset process is also reduced; this cannot be compensated to a corresponding degree by additional binder in the coat because the latter in turn influences the two basic values considered decisive for the cold-set process.

It has been shown that a glazing to smoothness values of more than 1,000 sec. Bekk. of a basically cold-set-suitable printing paper destroys the cold-set suitability. Smoothnesses in the range of approx. 500 sec. Bekk still seem feasible. Acceptable gloss values can be attained according to the invention with smoothnesses as of 250 sec. Bekk. A preferred range is 300 to 400 sec. Bekk. The finishing of the paper with such a smoothness may already have reactions on the pressability and printability in the cold-set process, however.

But even a glazing to smoothnesses in the 500 sec. Bekk. range does not yet necessarily lead to a paper with a strived-for gloss which, measured according to Lehmann, should be at least roughly 25% at a 75° angle. The gloss for the indicated limited smoothness can be increased by the selection of suitable coating pigments. This selection is relatively stratified, however, such that it is practically impossible to individually indicate the coating pigment compositions leading to the success strived for. This is made even more difficult by the fact that different coating pigment compositions as a rule also require qualitatively and quantitatively different binder compositions / proportions, which in turn have a reaction on the basic values required for the cold-set suitability. The paper according to the invention is therefore defined by minimum gloss values in addition to the ranges for water absorbency, ink absorption and smoothness. Within the framework of the tests taken as a basis for the invention, basic selection criteria were determined that lead to the strived-for success and provide the expert a sufficient lesson as to how he shall proceed. These selection criteria are included in subclaims. In addition, the added examples of execution contain concrete details as to how a paper according to the invention can be produced.

The possible and preferred limits for the smoothness values to be adhered to were already indicated. Water absorption according to the Emco test should be situated in the 85–25% range after one second, preferably in the 70–30% range. The ink absorption test should yield a value of 1.1 to 0.25, preferably a value of 0.8 to 0.3. Gloss measured according to Lehmann at 75° should be at least 25%, but preferably between 30 and 55%, to yield a glossy appearance of the paper that is commonly considered sufficient.

The testing methods used, in particular the method of gloss measuring, are explained in more detail further below. The penetration test according to Emco and the ink absorption test are defined as already described in EP-A-0 785 307.

The paper described in this case as well must have a pick-resistance sufficient for the offset process; this pick-resistance is determined and qualitatively assessed in typical manner. In this regard as well, the statements in EP-A-0 785 307 are referred to.

Fine-particle pigments in the coat composition generally accelerate printing ink drying (shortening of the ink absorption time, expressed by a lower densitometer value) and water absorption. With the selection and/or mixture of the pigment grading the expert therefore has the ability, according to the invention, to influence both values. If it is possible with a specific printing machine arrangement to press a paper that has very rapid ink absorption times, highly active synthetic binder is preferably chosen as binder for the coater, in connection with polyvinyl alcohol to the extent possible. The binder for such a coater can thus consist of 6-12% synthetic binder and from 1% to 4% PVA in relation to coating pigment. If a longer ink absorption time is required with the same water absorbency, this can be achieved by additional binders in the coat recipe, for example by adding 0.5 to 1.5% carboxyl methyl cellulose (CMC), depending on the composition of the coating pigment. If the binder is given additional starch, in the range of roughly 6–10 weight percent, for delaying the ink absorption time, this may also have a reducing influence on water absorbency.

Beyond the binder content and mixture also influenced by the fineness of the gloss-developing pigments used, the necessarily high water absorbency, the desired printing ink drying time and a good coat setting should be taken into account. In addition, it should be taken into consideration that the paper gloss values decrease as the binder content increases. Altogether, the binder content in the coater should not exceed 18 weight percent in relation to coating pigment. The higher values below this limit come into consideration when starch and/or CMC are used in addition to synthetic binders.

In paper coating, in general the following types of binder are used, in order of decreasing binding action: plastic dispersions (e.g. styrol-butadiene, acrylate, styrol-acrylate), PVA, protein or casein, starch. Highly active binders are the aforementioned plastic dispersions, also in combination with PVA. For certain binders, the adding of a cross-linking agent may be required.

If work is only done with highly active, synthetic binders in certain cases of application, the total binder proportion may be below 16 weight percent in relation to coating pigment, preferably even below 14 weight percent. Besides its binding force, PVA also has the property of being absorbed irreversibly on surfaces that have a relatively inert reaction capacity, as is true in the case of the calcium carbonate used within the framework of the invention.

The binder proportions may be as follows:

| | |
|---|---|
| plastic binder | 3–10 weight percent |
| PVA | 0–5 weight percent |
| protein | 0–5 weight percent |
| starch | 0–10 weight percent |
| CMC | 0–2 weight percent |

In the case of the classic coating pigments, after the gloss development increases, the ink absorption time decreases and the binder requirement (higher pigment surface) increases as the degree of fineness increases, the pigments must be selected and composed according to the requirements of the invention.

Pigments with a higher degree of paper gloss development are a) kaoline qualities with high grain fineness (94–100%<2 μm), such as Amazon 88, Euroclay FC, Hydraglass E, etc.

b) Natural, ground calcium carbonates (GCC) with a fineness of 98±5%<2 μm, such as Carbilux, Setacarb HG and M, Hydracarb CCM, etc.

c) Synthetic, precipitated calcium carbonates (PCC) with a mean particle size of preferably 0.5–1.0 μm. In this product group, preferably products with rhombohedral crystal shape are advisable because of the more advantageous binder requirement. Needle-shaped PCC qualities, such as aragonites and scalenohedric particles require high binder proportions for setting on the body paper and lead to extremely short ink absorption times. The needle-shaped pigments proposed in EP-B-0 377 983 have, according to the presentation therein, a high oil adsorption, which is roughly synonymous with a high binder adsorption.

d) Synthetic pigments:

This product group indeed increases paper gloss development, but reduces the wet pick-resistance and increases coat costs.

It has proven advantageous to work with pigment blends, whereby the advantages of the individual pigments can be made use of and the disadvantages can be reduced. For this reason, for controlling the coat quality the use of laminar pigments with lower grain fineness can also be sensible. Thus, for example, by also using a kaoline with laminar particles, of the SPS quality of the company ECC with a fineness of 80%<2 μm and a particle shape factor of 21, the coating hold-out of color systems containing a high degree of fine particles is improved, whereby gloss development increases and ink absorption time is prolonged.

In addition, the coaters used may contain typical additives, such as up to 1.5 weight percent melamine formaldehyde resin as a wet-strength agent, up to 0.4% carboxyl methyl cellulose (CMC) as a solution, optical lightener and/or chemicals for pH value setting, such as NaOH.

The coaters according to the invention are processed in aqueous slurry with solid contents of 30–65 weight percent of mathematical dry mass. As application processes, scraper application processes such as Inverted Blade, Jet Flow as well as roller application devices such as the Massey coater and also film presses such as the Jagenberg film press, the Speedsizer or the Metering Size Press from Beloit come into consideration. The paper according to the invention is therefore essentially independent of the type of coat application process, although one or the other application method can lead to a better result under certain conditions. As is well-known, scraper coating processes equalize the paper surface and therefore locally lead to coat application of different thicknesses, while roller coating devices rather produce a uniform coat application, which can be positive for the ink absorption behavior under certain circumstances. A gentle coat drying can also be significant, so that undesired binder migration phenomena do not worsen the strived-for uniform micro-capillarity of the coat application.

In the case of single-coated papers, according to the invention mathematical dry coating quantities with a mass surface density of more than 4 g/m$^2$ and side are applied on the base paper. Mass surface densities of 6–12 g/m$^2$ and side, typically approx. 7 g/m$^2$ and side, are preferred.

The invention is not limited to single-coated paper, however. It is also applicable to double-coated paper. Double coats have a mass surface density of at least 15 g/m$^2$ and side, typically 20 g/m$^2$ and side, in connection with which the coating mass is spread roughly uniformly on both coat applications. The cover coat is obviously decisive for the paper's properties according to the invention. If a coat application is discussed within the framework of this description without it being designated in more detail, for single-coated papers the sole coat application is meant and for double-coated papers the cover coat is referred to. The pre-coat in the case of double-coating is always expressly designated as such within the framework of this description. The pre-coat may have a composition differing from the cover coat.

It may be useful to presmooth the base paper before application of the single coat or the pre-coat, for example in a machine-glazer at the end of the paper machine, which may also be equipped with a so-called soft-nip.

The invention is not limited to the use of a specific base paper. Thus, wood-free as well as wood-containing base papers and those with a considerable portion of processed, used paper fibers can be used. Thus, for example, a wood-free base paper is suitable whose furnish for the paper production contains in mathematical dry portions roughly 78% cellulose, roughly 20% mineral filler, roughly 1% starch and roughly 1% other adjuvants.

However, wood-containing base papers that additionally contain a portion of processed used-paper fibers are preferred for reasons of cost alone. In addition, wood-containing base papers as a rule also have printing advantages, for example greater opacity. The fibrous furnish for a wood-containing and used-paper-containing base paper can consist, for example, in relation to mathematical dry total fibrous substance, of roughly 20% cellulose, 20% wood pulp and 60% used-paper substance. In relation to the fibrous substance, the furnish may also contain up to roughly 50% mineral filler, which corresponds roughly to a ⅓ portion of the substance composition. As is well-known, this filler quantity does not remain completely in the paper in the production process, but rather partially makes it way into the process water.

Within the framework of this description, when wood pulps are spoken of as fibrous component, these may be all such substances that are typically understood in paper technology with this expression, namely wood pulp, thermomechanical wood pulp (TMP), chemico-thermo-mechanical wood pulp (CTMP), etc.

A further important precondition for an acceptable printing result when printing on a paper with cold-set printing inks, in addition to a satisfactory drying of the printing inks, is the dimensional stability of the paper. Since water also penetrates into the base paper carrying the coat during the absorption of the cold-set printing inks, this has an affect on the fiber's bond to each other and thereby influences the dimensional stability of the paper. This influence is greater compared to normal newspaper-printing natural paper, because with a coated paper with comparable mass surface density the base paper as body paper for the coat only receives a correspondingly smaller mass portion, that is, the base paper is thinner. The dimensional stability of a paper under the influence of moisture can be improved by additives, for example starch. Thus, it is typical to add roughly 0.5 to 2.0% starch to a base paper furnish. For papers that are produced on open endless wire paper-making machines or on so-called hybrid-formers in which an upper dewatering screen is combined with the endless wire only after successful sheet formation on it and that, as a result of this production process, have a relatively favorable fiber orientation relation, namely a crosswise-to-lengthwise ratio of roughly 1:2 up to a maximum of 1:2.5, the dimensional stability for their use in the cold-set printing process is possibly already sufficient without starch being added to the base paper at all. Due to the fiber orientation mainly in the production direction, that is in the longitudinal direction of the paper, the lacks in dimensional stability consist essentially in a crosswise contraction, which is further increased by the pull of the paper web in the processing machine.

Mass-production printing papers are economically produced nowadays only on very fast-running paper machines which use exclusively so-called gap-formers according to the current state of the art. With these gap-formers the sheets are formed in the convergence gap of two screens. With papers produced on such modern machines, the crosswise-to-lengthwise ratio of the fiber orientation is substantially poorer and ranges from roughly 1:3 to 1:4. This results in a substantially lower crosswise stability of such papers. The dimensional stability of base papers produced on gap-formers can be sufficiently positively influenced if more than 1% to a maximum of 2%, typically roughly 1.5%, starch is added to the base paper furnish. The use of a highly cationic starch is preferred. Its effect consists in that when adding roughly 1.5% of this starch to the furnish, roughly 1.4% is found in the base paper, which indicates a surprisingly high retention of the starch during sheet formation, without the greater starch additive quantities remaining in the furnish without substantial effect on the base paper [sic] and at best increasing the waste-water load and the costs.

Since the paper according to the invention is first and foremost intended to cover the LWC range in the cold-set process, the mass surface densities of the finished paper are in the 40–80 g/m$^2$ range; masses of 54 and 60 g/m$^2$ are preferred.

The typical method for producing glossy paper qualities provides for a further work step, glazing, after the coating process. This mechanical surface treatment is carried out for conventional LWC papers on a 12-roller calender under high pressure (up to 350 KN/m) and at high temperatures (up to 100° C.). In this procedure, the paper is highly compressed, whereby the surface smoothness increases and the volume decreases, effects that are contrary to the cold-set process quality requirements. To adhere to the quality data required for this domain of paper use according to the invention, only a light glazing is possible, via which the required gloss development is nevertheless achieved. Bekk smoothness values of 250, in particular 300 to not more than 600 sec. where possible, still display the required micro-capillarity via which a high degree of water penetration is ensured and gloss values in the 30–50% range can be obtained.

The production according to the invention of a paper with typically sufficient gloss but relatively little glazing and correspondingly low smoothness leads to a printing paper which, in addition to its cold-set suitability, has the following advantages compared to highly-glazed, glossy papers:

greater specific volume greater stiffness greater dimensional stability, and thereby improved passage preservation greater track stability during pressing less loss of lightness and whiteness less fiber mottling greater opacity.

In addition to the classic supper-calender, in which not all roller nips are necessary for setting these low surface smoothnesses, other on-line and off-line smoothing aggregates are suitable for paper finishing, such as soft and Janus calenders.

Unless otherwise indicated in this description, percentages, even if this is not expressly mentioned, are always to be understood as weight percentages. Furthermore, unless otherwise specifically indicated, the percent quantities as well as other quantities always relate to the mathematical dry component. In this connection, the indication "otro" ["o-dry" ] relates to an oven-dry condition.

For measuring the immediate water absorption and/or penetration of a paper sample, the Dynamic penetration measuring apparatus DPM 27 of the company Emco Elektronische Mess- und Steurungstechnik GmbH in 04347 Leipzig, Gorkistrasse 31, is used. The testing method is based on this company's equipment description and operating instructions at the Mar. 13, 1995 status. The drop in the ultrasonic transmission value is measured starting from the measured value of the non-impregnated sample, which is equated with 100%, over the time. At the given time the measured value is indicated as a percentage of the initial value, which is equated with 100%. Basically speaking, this is a matter of a dynamic test in which a curve of the transmission drop is plotted over the time. This curve first drops steeply, then turns up and, at measuring times above 6 sec., approaches more or less asymptotically a specific transmission value. For the behavior of the paper, essentially the water absorption in the first moment is decisive, which is why the measured values after a time of 1 sec. are indicated for the purposes of this description. But the measured values after 3 sec. also have a certain significance for the evaluation; a time at which the steep curve drop swings approximately into the horizontal and a certain saturation point thus results. This testing method is designated in the following as an Emco test and the values are indicated in percentages (percent residual transmission, starting from 100%).

For determining the ink absorption, an absorption test, modified in the patent applicant's company and using the Dr. Dürner system multi-purpose sample printing machine of the company Prüfbau Dr.Ing. Herbert D ürner, Peissenberg, is used. In the ink absorption test, under defined conditions a sample print is produced with a standard printing ink, which is brought into contact under pressure with a counter-paper after a defined period of time. The printing ink intensity printed on the counter-paper is measured with a densitometer. In detail, during the counterpressure test, also designated as a blotting test or absorption test, a defined quantity of printing ink is applied on a strip of paper which is then rolled on section by section with a counter sample strip at predetermined intervals. The quantities of ink released on the counter sample strips are determined optically and allow conclusions as to the ink absorption behavior and the stacking behavior of the sample strip.

Details of the test execution can be seen in a thorough description for the multi-purpose sample printing machine of the company Prtüfbau Dr.-Ing. Herbert Dürner, Aich 17–23, D-82380 Peissenberg/Munich, of Sep. 26, 1972, in particular under 10.5 and 14.2.

Accordingly, for coated papers an inking supply of 0.3 $cm^3$, a distribution time of 30 sec. in the inking unit and 30 sec. for the printing form are recommended. The contact pressure for the pressing and counterpressure should each be 200 N/cm, that is, 800 N for a printing form width of 4 cm. The absorption test ink no. 52 0068 of the Michael Huber ink factories in Munich should be used. The counterpressure should be carried out after 30, 60, 120 and 240 sec. As printing speed, 0.5 m/sec. is recommended. A standard paper with the designation APCO II/II of the Scheufelen company should be used as the sample printing paper.

In the present case, the tests were conducted at double printing speed and otherwise with the indicated values. The ink transfers onto the counter sample strip were evaluated that were attained after 30 sec. of counterpressure.

For measuring the gloss, the gloss measuring apparatus LGDL-02 Lab of the company Lehmann, Mess- und Regeltechnik in Biel, Switzerland, is used. The gloss measuring head LGML-02 for labs with an irradiation and re-radiation angle of 75° is used. The testing standards used for the gloss measuring are E DIN 54502 test of paper and cardboard, gloss evaluation of level paper and cardboard surfaces with the help of reflectometer values and Zellcheming specification V/22/72 test of paper, cardboard and pasteboard; measurement of the gloss.

Below are a few examples of execution.

On a fast-running paper machine with a double screen former (gap former) a base paper was produced from the following furnish at a machine speed of roughly 1,300 m/min:

| | base paper furnish |
|---|---|
| wood pulp | 12.3% |
| cellulose | 13.0% |
| used paper | 40.0% |
| filler | 33.0% |

-continued

| | base paper furnish |
|---|---|
| highly cationic starch | 1.5% |
| retention agent | 0.2% |
| | 100% |

| | testing data of the base paper |
|---|---|
| mass surface density | 39.9 $g/m^2$ |
| filler portion | 14.9% |
| braking load lengthwise | 42.0N |
| braking load crosswise | 11.7N |
| fiber orientation crosswise to lengthwise | 1:3.5 |
| lightness | 73.0% |
| volume | 1.52 $cm^3/g$ |

Various coating tests were conducted with the base paper according to this example.

The test data reproduced in the following are those of a coating test with a coater with high kaoline content and those of a coating test with a coater that contained a rhombohedral, precipitated calcium carbonate as pigment. In the following table, there are details for both coating tests on the coater absorption, coat application and paper testing results.

| | FG [solid contents] | High kaoline coater | High PCC coater |
|---|---|---|---|
| Coater recipe: | | | |
| Pigments | | | |
| Rhomb. coating (MPS 0.5 $\mu$m) | 72% | | 100 |
| Amazon 88 | 74% | 50 | |
| SPS | 66% | 50 | |
| Binder | | | |
| Low-viscosity PVA | 20% | 2.0 | 2.0 |
| Plastic binder | 50% | 7.0 | 7.0 |
| Starch | 23% | 6.0 | 6.0 |
| Optic lightener | 100% | 1.3 | 1.3 |
| Cross-linking agent (MF-resin) | 73% | 1.3 | 1.3 |
| Synth. thickener | 25% | — | 0.2 |
| Coat weight: | $g/m^2$ | 7.0 | 6.9 |
| Moisture | % | 5.5 | 5.6 |
| Paper testing results: | | | |
| Mass surface density | $g/m^2$ | 54.0 | 54.0 |
| Smoothness according to Bekk | sec. | 500 | 510 |
| Gloss 75° according to Lehmann | % | 41 | 35 |
| Lightness | % | 74.9 | 76.4 |
| Whiteness with UV | % | 77.3 | 81.9 |
| Opacity | % | 92.1 | 91.5 |
| Ink absorption time after 30 sec. | | 0.4 | 0.3 |
| Wet pick-resistance (1 = very good, 6 = very poor) | | 2 | 2 |
| Emco measurement after 1 sec. | % | 48 | 51 |

In the text column of the table, for the coater recipe for the individual components the respective solid contents of the products are indicated on the right under the heading "FG". In addition, the text column contains on the right the measuring units for the measured values. In the value columns, in each case mathematical dry portions are indicated for the coater absorption. In addition to the coating pigments used for the tests, the following details are also provided:

Amazon 88

This is a matter of a kaoline for paper coating purposes of the company Cadam, Monte Dourado, Brazil, distributed by the company Kaoline International, NL-3447 Gv Woerolen, with a fineness of 96% <2 μm. The wet screen residues of particles >95 μm amount to 0.0035%. The whiteness level according to ISO 2740 is 86%.

SPS

This quality is a kaoline with laminar particles of the company ECC International. The shape factor of this pigment is 21, the degree of fineness is 80% of the particles<2 μm and 66%<1 μm.

Rhomb. Coating (MPS 0.5 μm)

This pigment is a precipitated calcium carbonate with rhombohedral crystal structure of the company Faxe Kalk, DK-1017 Copenhagen K. The pigment has a fineness of 0.5 μm.

The test results show that with intentionally set smoothnesses of roughly 500 sec. Bekk, gloss values of 41% were achieved for the coater with high kaoline content and 35% for the coater with PCC. The water absorption measurement according to the Emco test was 48 and, respectively, 51% and is thereby within the preferred range. The same applies to the ink absorption test with values of 0.4 and, respectively, 0.3.

The pick-resistance was to be considered good with the note 2. When using less smoothing with the same papers which led to smoothness values of roughly 250 sec. Bekk, no sufficient gloss values were able to be obtained with the coat compositions used. With an additive of 10% synthetic pigment to the coating pigments, a somewhat greater gloss was indeed able to be achieved, but the wet pick-resistance as the measure for offset suitability decreased, however.

When glazing a cold-set-suitable mat paper with 100% ground calcium carbonate as coating pigment, no sufficient gloss was able to be obtained with glazing to a smoothness of 500 sec. Bekk. The gloss was roughly only 18%. The opacity of the two test papers with values in the 92% range corresponds roughly to the opacity of a comparable mat paper and is thus to be considered very good.

What is claimed is:

1. A glossy, coated web printing paper for use with cold-set inks in a cold-set offset printing process, comprising:

a base paper, comprised of
paper fiber, and
a mineral filler; and a coat application, comprised of
coating pigment, and
binder, wherein said paper exhibits
a value in an Emco penetration test after one second of from 25 to 80%,
a value in an ink absorption test of from 0.25 to 1. 1,
a smoothness value according to Bekk of from 250 to 600 sec., and
a gloss value measured with a Lehmann apparatus at 75° of 25% or more.

2. The printing paper according to claim 1, wherein the value of said Emco penetration test is from 30 to 70%, the value of said ink absorption test is from 0.3 to 0.8, and the smoothness value according to Bekk is from 300–400 sec.

3. The printing paper according to claim 1, wherein the gloss value is from 30 to 55%.

4. The printing paper according to claim 1, wherein said coating pigment comprises particles in which 93% are smaller than 2 μm.

5. The printing paper according to claim 1, wherein the coating pigment comprises at least one member from the group consisting of kaoline with a grain fineness wherein 94 to 100% of said grains are less than 2 μm,
natural, ground calcium carbonate with a grain fineness wherein 93 to 100% of said grains are less than 2 μm,
synthetic, precipitated calcium carbonate with a mean particle size of from 0.5 to 1.0 μm, and
synthetic pigment.

6. The printing paper according to claim 5, wherein said synthetic, precipitated calcium carbonate is a rhombohedral crystal shape.

7. The printing paper according to claim 5, wherein said coating pigment comprises laminar particles in which 80% are less than 2 μm.

8. The printing paper according to claim 1, wherein said binder comprises a synthetic binder which contains starch, and wherein a binder content of said coat application is less than 18 weight percent starch-containing binder, in relation to said coating pigment.

9. The printing paper according to claim 1 wherein said binder comprises a synthetic binder without starch, and wherein a binder content of said coat application is less than 16 weight percent starch-free binder, in relation to said coating pigment.

10. The printing paper according to claim 1, wherein the binder content of said coat application is less than 14 weight percent, in relation to said coating pigment.

11. The printing paper according to claim 1, wherein said binder of said coat application comprises 6–10 weight percent synthetic binder and 1–4 weight percent PVA, in relation to coating pigment.

12. The printing paper according to claim 1, wherein said binder of said coat application, as a weight percent of said coat application, comprises:

3–10 weight percent plastic binder,
0–5 weight percent PVA,
0–5 weight percent protein,
0–10 weight percent starch, and
0–2 weight percent carboxyl methyl cellulose.

13. The printing paper according to claim 1, wherein said coat application has a mass surface density for single-coated papers of more than 4 g/M$^2$ and side.

14. The printing paper according to claim 13, wherein said mass surface density for single-coated papers is 7–12 g/m$^2$ and side.

15. The printing paper according to claim 1, wherein the paper fiber of the base paper, in percent of oven-dry fiber, comprises:

10–50 weight percent cellulose;
15–60 weight percent wood pulp; and
0–70 weight percent fiber from processed used-paper.

16. The printing paper according to claim 15, wherein said base paper comprises up to 18 weight percent mineral filler, in relation to oven-dry paper fiber.

17. The printing paper according to claim 1, wherein said base paper comprises at least 0.5 weight percent of a highly cationic starch.

18. The printing paper according to claim 17, wherein said starch content of said base paper is at least 1.3 weight percent.

19. The printing paper according to claim 1, wherein a mass surface density of the finished paper is from 40–80 g/m$^2$.

20. The printing paper according to claim 19, wherein said mass surface density is from 50–65 g/m$^2$.

* * * * *